US005243716A

United States Patent [19]

Zaccai et al.

[11] Patent Number: 5,243,716

[45] Date of Patent: Sep. 14, 1993

[54] BARRIER-FREE DRAINAGE APPARATUS

[75] Inventors: Gianfranco D. Zaccai, Boston; Andrew Ziegler, Arlington; Thomas J. Misage, Somerville; Timothy C. Dearborn, Wellesley, all of Mass.

[73] Assignee: Herman Miller, Inc., Zeeland, Mich.

[21] Appl. No.: 731,424

[22] Filed: Jul. 17, 1991

[51] Int. Cl.[5] ..... A47K 3/22; E03F 5/06

[52] U.S. Cl. ..... 4/604; 4/613; 210/164

[58] Field of Search ..... 4/596, 604, 612, 613, 4/614, 654, 650, 653, 679, 680, 695, 696; 210/498, 164

[56] References Cited

U.S. PATENT DOCUMENTS

| | | | |
|---|---|---|---|
| D. 255,829 | 7/1980 | Swenson | D23/283 |
| 488,117 | 12/1892 | Doolittle | 210/164 |
| 555,485 | 2/1896 | Johnston | 210/164 X |
| 630,533 | 8/1899 | Fiske | 210/164 X |
| 1,587,693 | 6/1926 | Beland et al. | 4/654 |
| 1,684,503 | 9/1928 | Nilson | 4/613 |
| 2,305,955 | 12/1942 | Dudley | 210/164 |
| 2,701,027 | 2/1955 | Scoville | 210/163 |
| 2,757,385 | 8/1956 | Whittick | 4/613 |
| 3,349,917 | 10/1967 | Strickland | 210/164 |
| 3,431,566 | 3/1969 | Feldhege | 4/680 |
| 3,551,918 | 1/1971 | Bergmark | 4/613 |
| 3,593,347 | 7/1971 | Nemiroff | 4/679 |
| 3,606,617 | 9/1971 | Frazier | 4/613 |
| 3,800,335 | 4/1974 | Buonaura | 4/613 |
| 4,198,715 | 4/1980 | Daniels | 4/612 |
| 4,296,508 | 10/1981 | Moran | 4/540 |
| 4,551,870 | 11/1985 | Presti, Jr. | 4/613 |
| 4,557,004 | 12/1985 | Piana | 4/613 |
| 4,899,402 | 2/1990 | Maynard et al. | 4/613 X |

FOREIGN PATENT DOCUMENTS

| | | | |
|---|---|---|---|
| 2908549 | 9/1980 | Fed. Rep. of Germany | 210/164 |
| 3514489 | 10/1986 | Fed. Rep. of Germany | 4/612 |
| 3620132 | 9/1987 | Fed. Rep. of Germany | 210/164 |
| 0279038 | 5/1990 | Fed. Rep. of Germany | 210/164 |
| 2562409 | 10/1985 | France | 4/612 |
| 0038649 | 3/1979 | Japan | 4/596 |
| 0058642 | 2/1990 | Japan | 4/584 |
| 0058643 | 2/1990 | Japan | 4/584 |
| 0210128 | 8/1990 | Japan | 210/164 |
| 7611865 | 4/1978 | Netherlands | 4/613 |
| 2108382 | 5/1983 | United Kingdom | 4/613 |
| 2244428 | 12/1991 | United Kingdom | 4/613 |

*Primary Examiner*—William A. Cuchlinski, Jr.
*Assistant Examiner*—John L. Beres
*Attorney, Agent, or Firm*—Willian Brinks Olds Hofer Gilson & Lione

[57] ABSTRACT

A barrier-free drainage apparatus includes a trough positioned adjacent the front edge of a platform. The trough has a bottom wall which is positioned below the front edge of the platform, and at least one outlet opening in fluid flow communication with a drain pipe. A grate is positioned inside the trough and has an upper, generally horizontal portion with a plurality of apertures therethrough. The upper portion is supported such each that said upper portion is spaced apart from the trough bottom wall in a generally horizontal position and a top surface of the upper portion is substantially the same height as the front edge of the platform. Another aspect of the invention is the configuration of the outlet openings. A plurality of spaced apart, elongated insert receptacles depend from the bottom wall. The insert receptacles have side wall means and a horizontal base which define a cavity, and each base has two spaced apart outlet openings therein adjacent opposing ends of the base. Elongated inserts have a hole adjacent one end thereof and are adapted to fit into the insert receptacles. A top surface of each insert slopes downward toward the hole. When assembling the drainage apparatus, the inserts are placed in the insert receptacles so that the insert hole is in alignment with one of the receptacle base outlet openings.

38 Claims, 6 Drawing Sheets

BARRIER-FREE DRAINAGE APPARATUS

BACKGROUND OF THE INVENTION

The present invention relates generally to shower systems, and more particularly, to a barrier-free drainage apparatus which allows a person to directly enter a shower stall without having to substantially elevate any portion of the body. Many bathtubs and shower stalls are adapted to accommodate invalids, elderly people, or others who find it difficult to raise their legs to step over the front wall of a shower pan or bathtub. These bathtubs typically include rotatable seats, hydraulically powered lifts, or other devices which transfer a person over the bathtub wall. Some shower stalls include a relatively low front wall to facilitate passage into the stall. Such a low threshold presents a trip hazard to ambulatory users who often drag their feet and/or walkers. A low front wall is also a danger to people with partial vision since it is more difficult to see.

The bathtub disclosed in U.S. Pat. No. 4,296,508 (Moran) allows a person to enter without stepping or being transferred over a sidewall. In Moran, the bathtub has a fixed portion and an end portion which is movable between an open and closed position. A person may either enter the bathtub when the end portion is in an open position, or sit on the end portion while it makes to abut and align itself with the fixed portion of the bathtub. One disadvantage of this type of bathtub is the difficulty of maintaining a watertight seal between the moveable and fixed portions of the bathtub. The bathtub disclosed in Moran also tends to be cumbersome and costly.

Furthermore, conventional shower pans typically have a platform which slopes toward a single drain hole in the center of the platform. Side walls of these platforms, including the front wall, must be relatively high to accommodate the slope of the platform and prevent water from flowing out of the shower pan. One such shower pan having a single drain hole in the center of the platform is illustrated in U.S. Pat. No. 255,829 (Swensen). The shower pan in Swensen has no front wall and includes a front portion which slopes downward away from the drainhole. Although the Swensen shower pan is barrier-free, it shows no means for preventing water from flowing out of the shower pan onto a bathroom floor.

SUMMARY OF THE INVENTION

Briefly stated, the invention is directed to a barrier-free drainage apparatus including a trough positioned adjacent a front edge of a platform, and grate means positioned inside the trough. The trough has a bottom wall positioned below the platform front edge, and the bottom wall has at least one outlet opening in fluid flow communication with a drain pipe. The grate means includes an upper, generally horizontal portion with plurality of apertures therethrough, and means for supporting the upper portion such that said upper portion is spaced apart from the trough bottom wall in a generally horizontal position and a top surface of the upper portion is substantially the same height as the front edge of the platform.

In a preferred embodiment, the platform slopes generally downward from a back edge to a front edge, and the trough has side walls, a back wall depending from the front edge of the platform, and a front wall having a top edge which is approximately the same height as a top surface of a finished floor. The trough bottom wall slopes generally downward toward a plurality of spaced apart drain openings. Preferably, the grate means comprises a plurality of removable grates. The grates include an upper portion having a combined length substantially the same as the distance between the trough side walls, and a width substantially the same as the distance between the trough front wall and the front edge of the platform. The upper portion of the grates also has an undulated cross-section defined by a plurality of alternating crests and valleys spanning a substantial width of the upper portion. The crests and valleys run longitudinally along a substantial length of the upper portions parallel to the front edge of the platform. In addition, the apertures are spaced apart in the center and along the length of the valleys.

The present invention provides significant advantages over other shower pans. Positioning the outlet openings in front of the platform allows the lowest portion of the shower pan to be in the front where a person enters. The sloped platform directs the flow of water into the trough and the sloped bottom wall of the trough directs the flow of water to the outlet openings. Furthermore, water drains faster if a plurality of outlet openings are provided rather than a single outlet opening, thus preventing water from accumulating in the trough and flowing over the front wall.

Another aspect of the invention is the configuration of the outlet openings. In a preferred embodiment, a plurality of spaced apart, elongated insert receptacles depend from the bottom wall. The insert receptacles have side wall means and a horizontal base which define a cavity, and each base has two spaced apart outlet openings therein adjacent opposing ends of the base. Elongated inserts have a hole adjacent one end thereof and are adapted to fit into the insert receptacles. A top surface of each insert slopes downward toward the hole. When assembling the shower pan, the inserts are placed in the insert receptacles so that the insert hole is in alignment with one of the receptacle base outlet openings. Thus, drain pipe installation is facilitated by allowing the drain pipe to avoid interference with an object underneath the shower pan such as a joist supporting a subfloor. In addition, the sloped top surfaces of the inserts direct the flow of water toward the insert opening.

Thus, an easily installable, barrier-free drainage apparatus is provided which allows a person to enter the shower stall without having to step over a front wall.

The present invention, together with further objects and advantages, will be best understood by reference to the following detailed description taken in conjunction with the accompanying drawings.

DETAILED DESCRIPTION OF THE PREFERRED EMBODIMENTS

Figure 1:
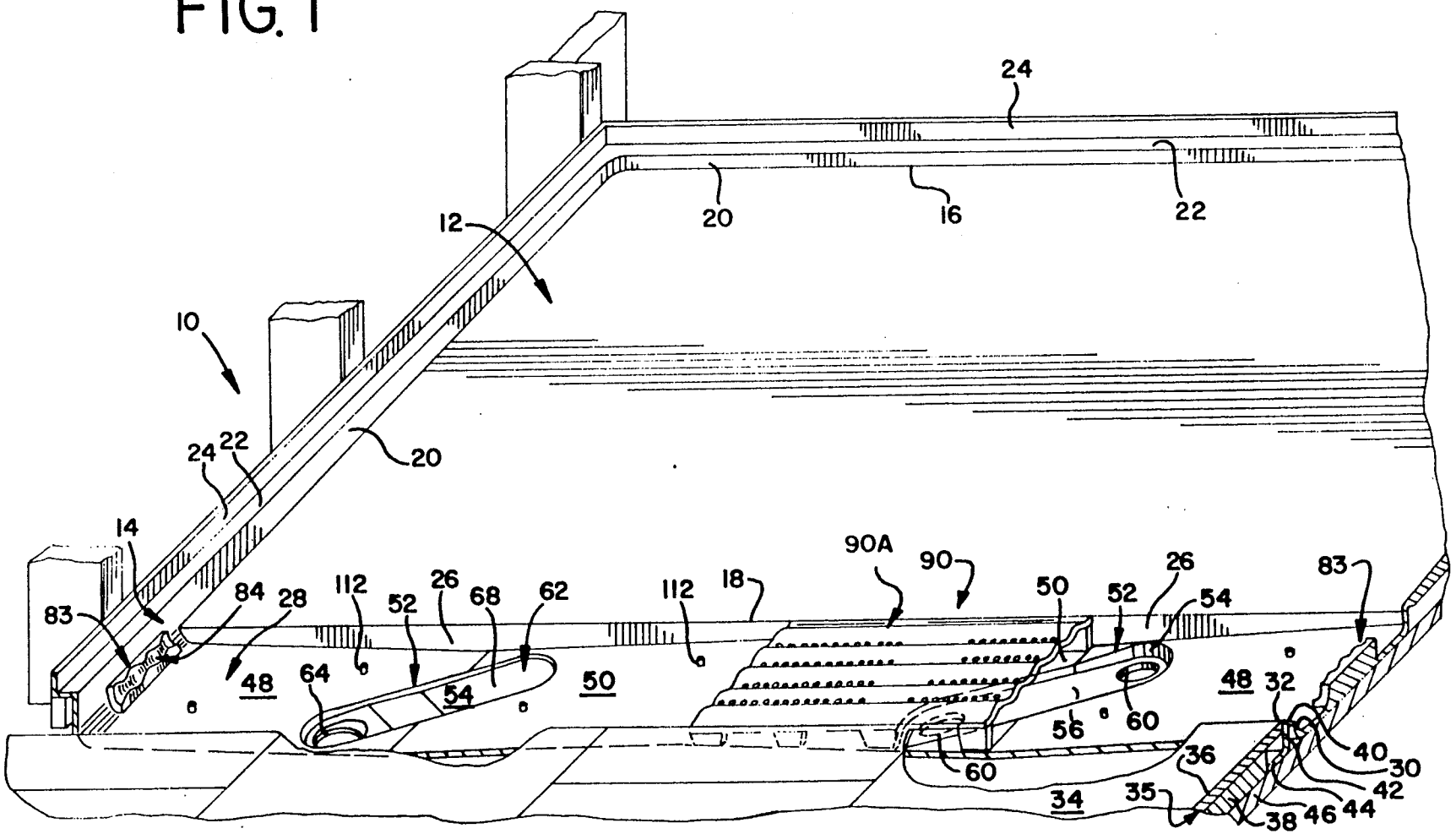
FIG. 1 is a perspective view of a preferred embodiment of a barrier-free drainage apparatus shown with three grates and an insert removed.

Referring to the drawings, FIGS. 1–4 show a preferred embodiment of a barrier-free shower pan indicated generally at 10. The shower pan 10 includes a sloped platform 12 and a trough 14 supported on a subfloor by support means (not shown). The platform 12 slopes downward from a back edge 16 to a front edge 18, and the trough 14 is positioned adjacent the front edge 18 of the platform 12. Side walls 20 extend upward from the platform 12 and trough 14. Preferably, horizontal flanges 22 extend outward from the side walls 20, and vertical flanges 24 extend upward from the horizontal flanges 22. Side walls 20 can be any shape or size as long as they direct water to the platform 12 and trough 14, and platform 12 can be any shape as long as it directs water downward toward the trough 14. The platform 12 and trough 14 can be made of any conventional material, such as thermo-plastic, thermoset plastic, or fiberglass. Preferably, the platform 12 includes a plurality of raised bumps 25 thereon for traction. In addition, trough 14 can be a stand-alone unit installable adjacent an existing shower stall or platform.

The trough 14 has a back wall 26 depending from the front edge 18 of platform 12, a bottom wall 28 which is lower than the front edge 18 of platform 12, and a front wall 30. The front wall 30 has a top edge 32 which is approximately the same height as a top surface 34 of a finished floor 35. The finished floor 35 can include a conventional covering 36, such as tile, linoleum, carpeting, or the like, placed on a floor 38. To provide smooth access to the platform 12, the covering 36 abuts the trough front wall 30. Preferably, a top portion 40 of the front wall 30 bends outward, and a support wall 42 depends from the top portion 40. A horizontal flange 44 extends outward from the support wall 42 and rests on a subfloor 46 to support the shower pan 10.

Since platform 12 slopes downward toward trough 14 and the trough is positioned below and in front of the platform, the lowermost portion of the shower pan 10 is in the front, thus allowing the top edge 32 of the front wall 30 to be the same height as the floor covering 36 rather than extending above the covering and acting as a barrier.

Preferably, the bottom wall 28 has lateral sections 48 which slope downward from the side wall 20, and center sections 50 which slope upward from the lateral sections 48. A pair of elongated insert receptacles 52 depend from the trough bottom wall 28 and are positioned at an angle relative to the back wall 26 and the front wall 30. One end of each receptacle 52 underlies a bottom wall lateral section 48 and the other end underlies the adjacent bottom wall center section 50. The receptacles 52 have a side wall 54 and a substantially horizontal base 56 which define a cavity 58. Each receptacle base 56 has an outlet opening 60 adjacent each end thereof.

Referring now to FIGS. 1–2 and 4–6, elongated inserts 62 are adapted to fit into the insert receptacles 52. The inserts 62 have a hole 64 adjacent an end 66, and a top surface 68 which slopes downward from an opposing end 70 to end 66. The inserts 62 are placed in the insert receptacles 52 so that the insert hole 64 is in alignment with one of the receptacle base outlet openings 60, and a conventional drain pipe 65 is attached to the outlet opening 60 and insert hole 64. A bottom face 72 of each insert 62 borders the insert hole 64 and rests on the receptacle base 56, and a plurality of legs 74 support a midsection of the insert 62. To prevent water from flowing out of the receptacle outlet opening 60 opposite the insert hole 64, a shim cap 76 is placed in the receptacle outlet opening. The shim cap 76 has cylindrical plug portion 78 which is substantially the same size as the receptacle opening 60, a flange 80 which bears against a bottom surface of the receptacle base 56, and a hole 81 in the center thereof. A boss 82 extends downward from the inserts 62 and is threadably attached to the shim cap 76 to secure the insert 62 to the receptacle base 56.

Thus, the sloped surfaces of the bottom wall 28 direct the flow of water toward the inserts 62, and the sloped top surfaces 68 of the inserts 62 direct the flow of water toward the insert holes 64 and out the corresponding receptacle base outlet openings 60. Any type of drain means can be used, and the bottom wall 28 can slope in various directions. However, directing the flow of water precisely toward the outlet openings diverts the flow of water away from the front wall, thus minimizing the required height of the front wall necessary to prevent water from flowing over the wall. In addition, providing a plurality of outlet openings allows water to drain faster, thus preventing water from accumulating in the trough 14 and flowing over the front wall 30.

Furthermore, the insert and receptacle configuration of the present invention facilitates pipe installation by allowing the drain pipe 65 to avoid interference with a joist supporting a subfloor. If a joist interferes with one of the insert receptacle openings, the insert is rotated 180° so that the insert hole is in alignment with the other receptacle opening.

Figure 7A:
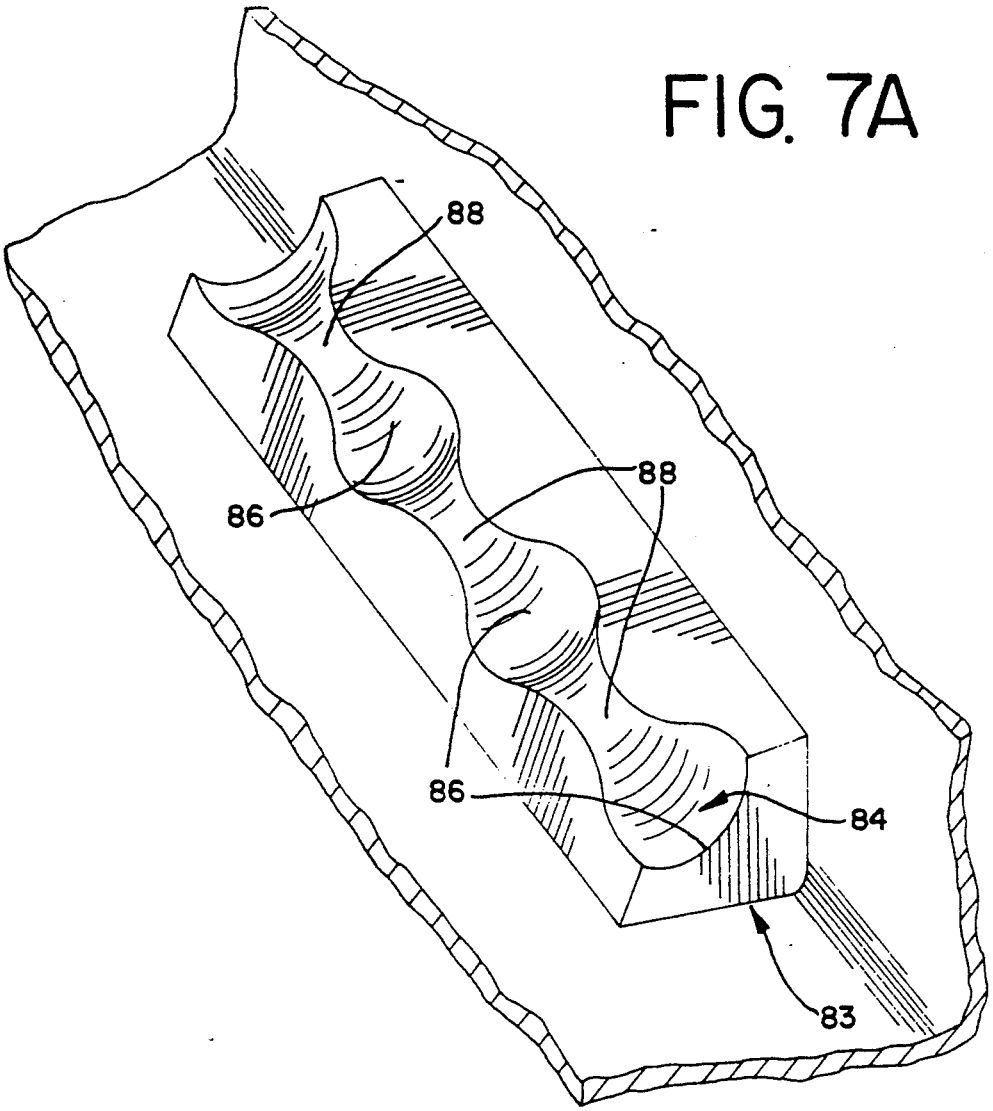
FIG. 7A is a perspective view of an undulated sidepiece.
Figure 7B:
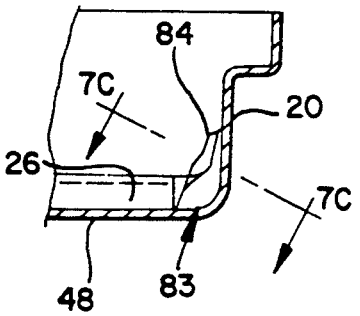
FIG. 7B is an exploded view of the undulated sidepiece encircled by a dotted line in FIG. 4.
Figure 7C:
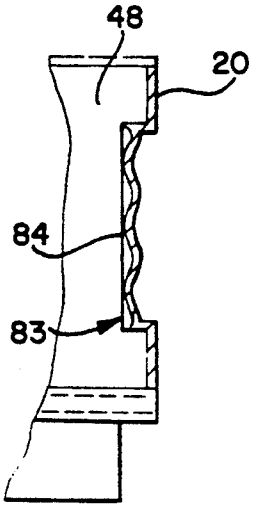
FIG. 7C is a cross-sectional view of the sidepiece taken along line 7C—7C in FIG. 7B.

Also in a preferred embodiment of the invention, sidepieces 83 extend outward from the junctures of the side walls 20 and the lateral sections 48 of the trough bottom wall 28. As best shown in FIGS. 7A–C, the sidepieces 83 have an undulated exterior surface 84 defined by alternating receded portions 86 and raised portions 88. The receded portions 86 have a larger radius of curvature than the raised portions 88, and are wider than the raised portions, resulting in a series of hourglass-like indentations along the length of the sidepieces 83. The undulated exterior surface 84 dampens waves of water flowing over the sidepiece so that such waves do not splash into or over the trough front wall 30.

Figure 2:
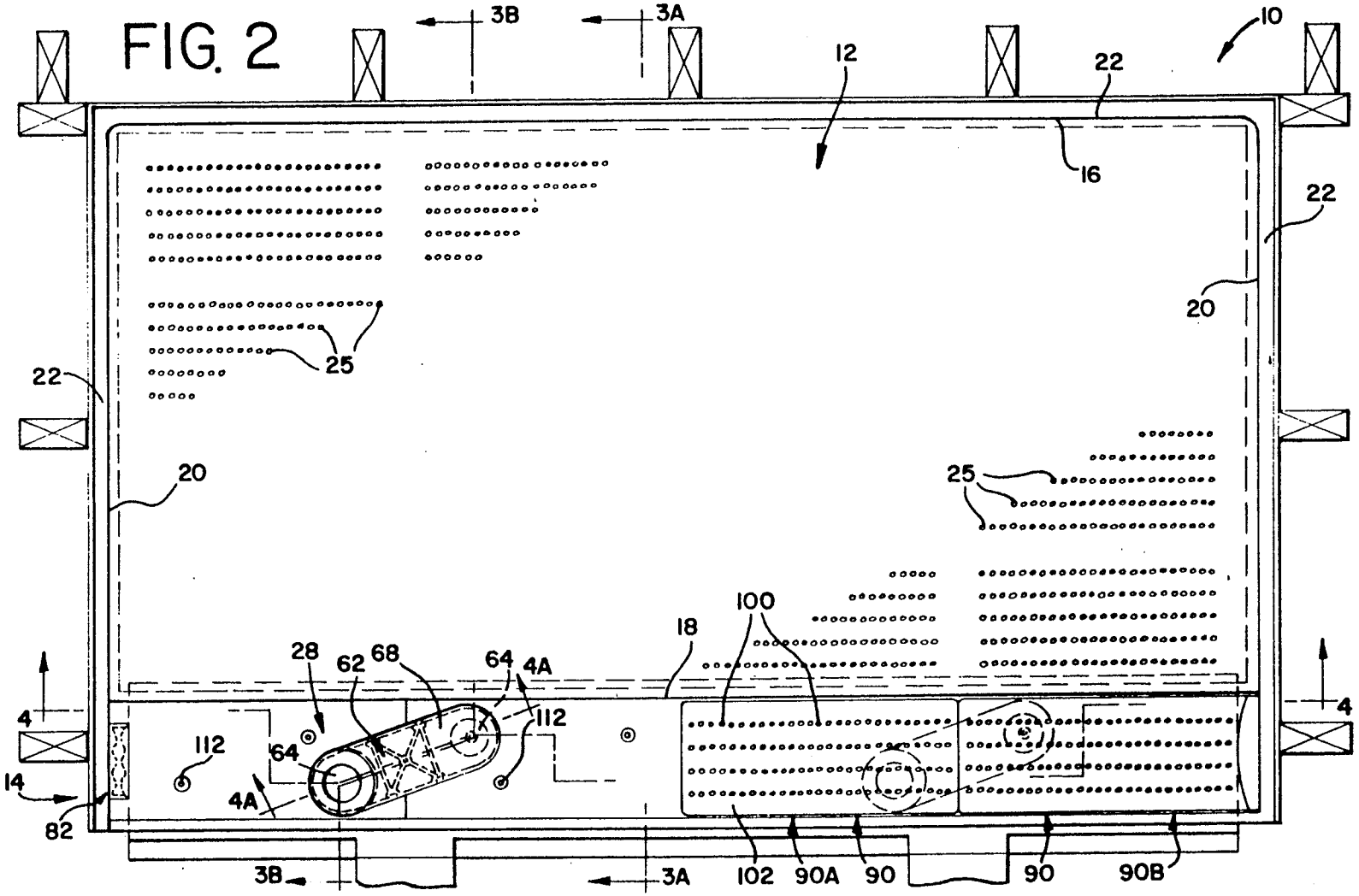
FIG. 2 is a top view of the drainage apparatus shown with two grates removed.
Figure 3A:
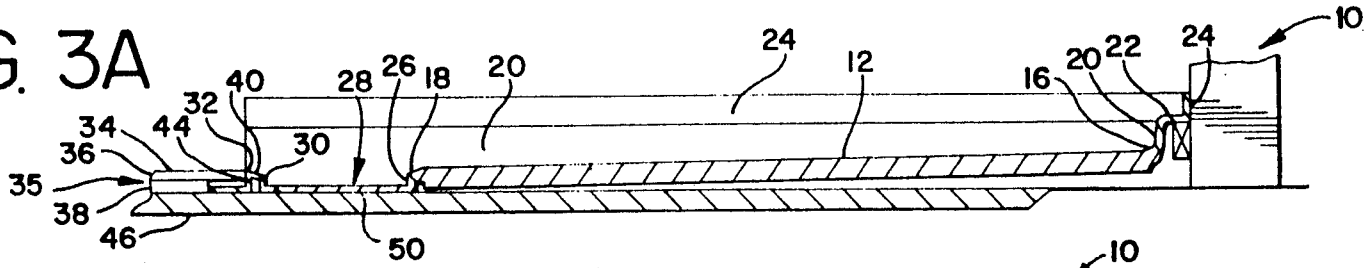
FIG. 3A is a cross-sectional view of the drainage apparatus taken along line 3A—3A in FIG. 2.
Figure 3B:
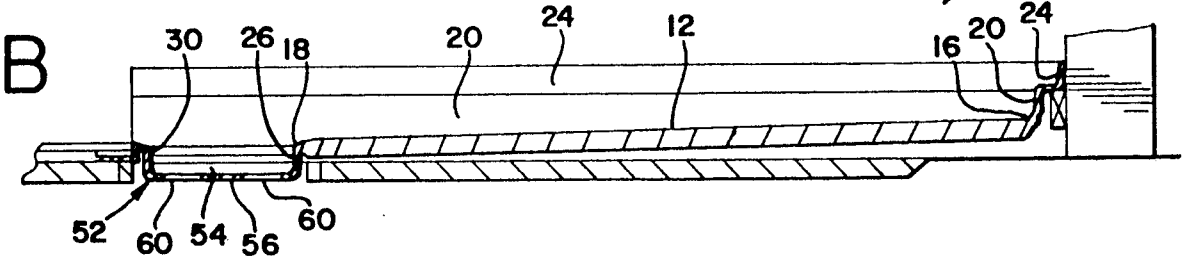
FIG. 3B is a cross-sectional view of the drainage apparatus taken along line 3B—3B in FIG. 2.
Figure 4:
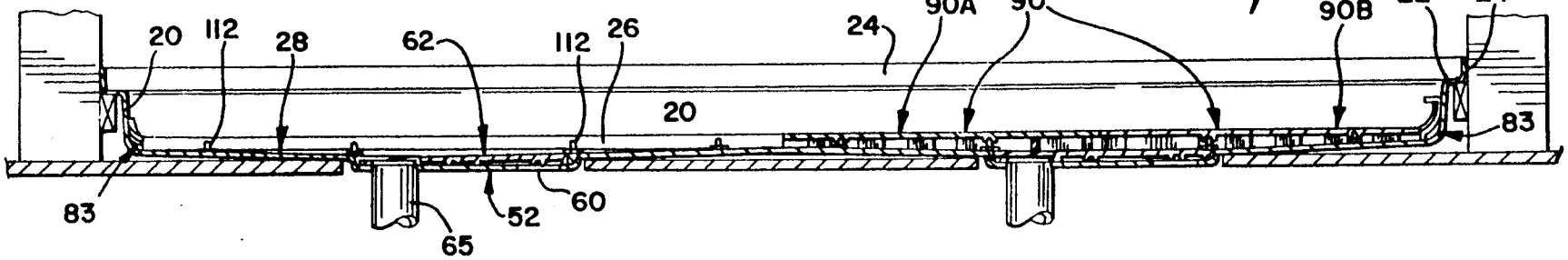
FIG. 4 is a cross-sectional view of the drainage apparatus taken along line 4—4 in FIG. 2.
Figure 4A:
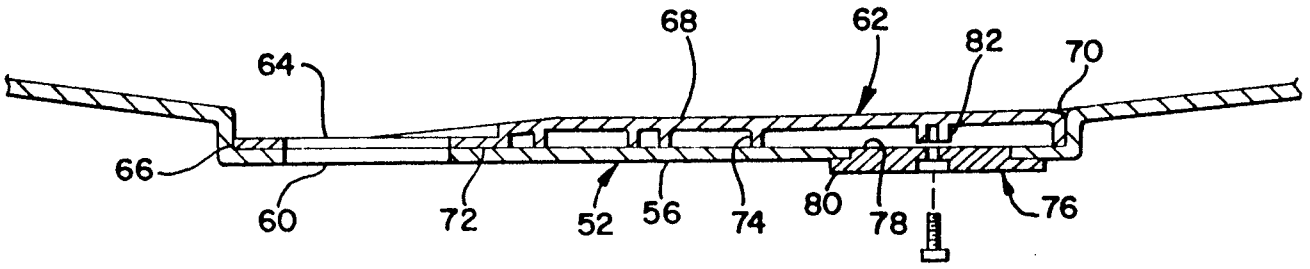
FIG. 4A is an exploded view of the insert and receptacle encircled by a dotted line in FIG. 4.
Figure 6:
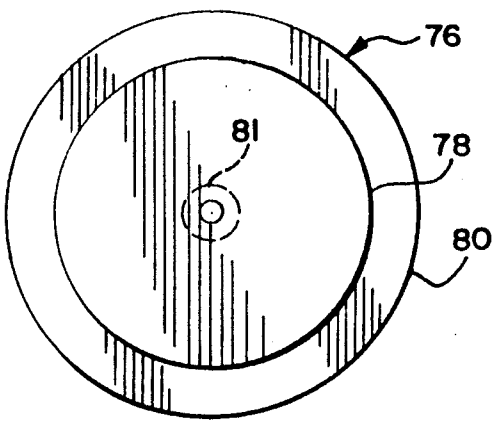
FIG. 6 is a bottom view of a shim cap.
Figure 5:
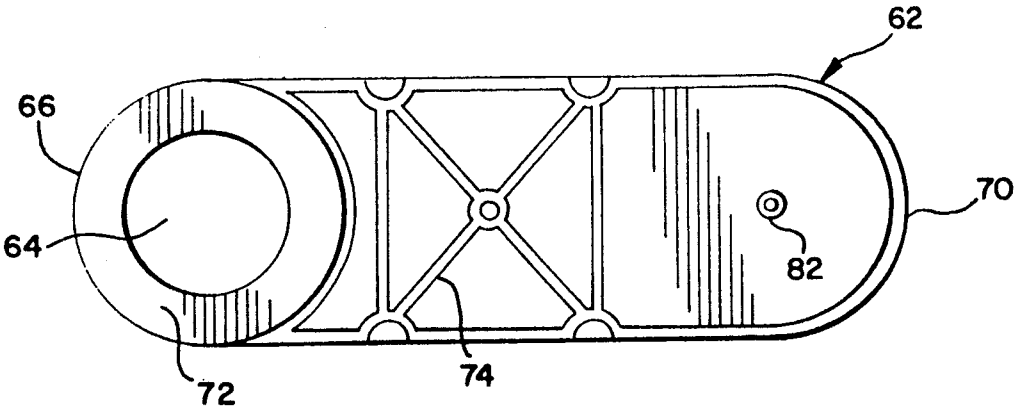
FIG. 5 is a bottom view of the insert.

Four removable grates 90, of which a middle grate 90A is shown in FIGS. 1, 2, and 4, and an end grate 90B is shown in FIGS. 2, 4, and 8–11, overlie corresponding lateral sections 48 and center sections 50 of the trough bottom wall 28. As best shown in FIGS. 8–11, each grate 90 preferably includes an upper portion 91 having undulated cross-section defined by a plurality of alternating crests 92 and valleys 94. The crests 92 and valleys 94 span the width of each grate 90 and run longitudinally along the length of the grates parallel to the front edge 18 of the platform 12. The crests 92 and valleys 94 dampen waves of water coming from the sloped platform 12. The end grates 90B overlying the bottom wall lateral sections 48 preferably have an end portion 96 which curves upward. The radius of curvature of the crests 92 on the curved end portion 96 gets progressively larger from the crest nearest the platform front edge 18 to the crest in the center of the grates 90. The height of the crests 92 on the curved end portion 96 thus increases from the front edge 18 of the platform 12 to the center crest in order to dampen larger waves of water tending to flow across the curved end portions 96. Preferably, a handle 98 extends horizontally outward from the end portion 96 so that the end grates 90B, and consequently the middle grates 90A, can be easily removed and installed.

Figure 9:
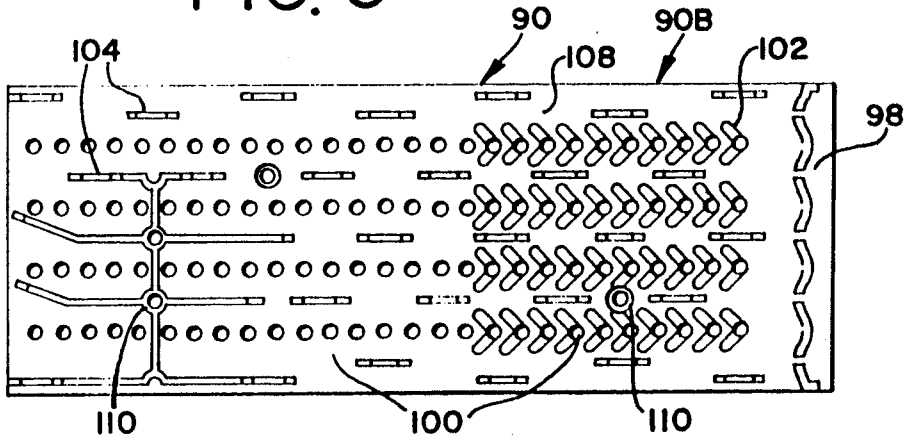
FIG. 9 is a bottom view of the preferred embodiment of the end grate.
Figure 11:
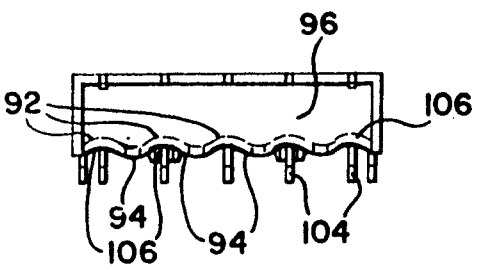
FIG. 11 is a side view the preferred embodiment of the end grate.
Figure 8:
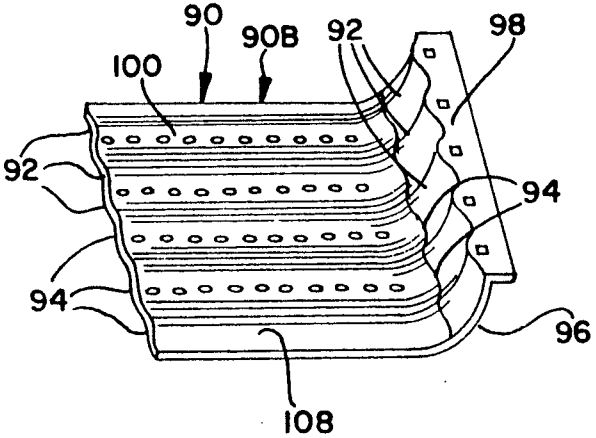
FIG. 8 is a partial perspective view of an end grate of the present invention.
Figure 10:
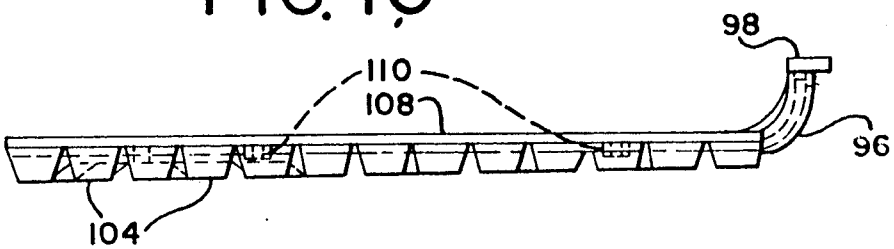
FIG. 10 is a front view of the preferred embodiment of the end grate.

Each grate 90 also has a plurality of spaced apart apertures 100 in the center of the valleys 94 along the length of the valleys. As shown in FIG. 9, scallop-shaped channels 102 are formed in the underside of end grates 90 adjacent a desired number of apertures 100 to facilitate the drainage of water in the direction of the insert holes 64. For a given aperture 100, one channel 102 extends horizontally at an angle away from the end portion 96 and toward one side of the end grate 90, and another channel 102 extends horizontally at an angle away from the end portion 96 and toward the opposite side of end grate 90.

A plurality of support legs 104 extend downward from a bottom surface 106 of the crests 92 and engage the trough bottom wall 28. The length of support legs 104 increases from the highest end of a corresponding section of the bottom wall 28 to the lowest end thereof so that a top surface 108 of the grate upper portions 91 is generally horizontal and approximately the same height as the front edge 18 of the platform 12 and the top edge 32 of the trough front wall 30. The end grates 90B overlying the sidepieces 83 are spaced apart from the sidepieces to allow water to flow over the undulated exterior surface 84 of the sidepieces 83. A plurality of sleeve members 110 extend downward from the grates 90 and slidably engage a plurality of knobs 112 extending upward from the trough bottom wall 28 to releasably secure the grates to the bottom wall.

Any grate means can be used which is adapted to be positioned such that a top surface is horizontal and approximately the same height as the front edge 118 of platform 12 and the top edge 32 of the trough front wall 30. However, it is desirable to have four grates overlying corresponding sections of the bottom wall to ease installation and removal of the grates. The four grates of the present invention are also small enough to fit inside a dishwasher for cleaning. The number, size, and configuration of the apertures 100, crests 92, and valleys 94 can also vary, keeping in mind that directing water through the grates and toward the outlet openings rather than allowing it to flow over the front wall minimizes the required height of the front wall. It is also desirable that the crests 92 be rounded to make it easier for a person to pass over the grates 90 on foot, with a walker, or in a wheelchair. Preferably, the inserts 62, sidepieces 83, and grates 90 are made of a thermo-plastic or thermoset plastic.

In operation of the shower pan 10, water flows from the sloped platform 12 to the grates 90. As the water flows over the grates 90, the crests 92 and valleys 94 break up any waves and the water drains through the apertures 100 into the trough 14. Waves of water flowing adjacent the side walls 20 are broken up by the undulated exterior surfaces 84 of the sidepieces 83. The water then flows over the sloped lateral sections 48 and center sections 50 of the trough bottom wall 28 toward the inserts 62. The water flows over the sloped top surfaces 68 of the inserts 62 toward the insert holes 64 and out the drain pipe 65.

Thus, a barrier-free drainage apparatus is provided which allows a person to enter the shower stall without having to step over a front wall. The grates can be easily removed and installed and are small enough to fit inside a dishwasher for cleaning. Also, the present invention makes cleaning a bathroom floor easier since water on the floor can be pushed into the trough. Furthermore, the insert and receptacle configuration of the present invention facilitates pipe installation by allowing a drain pipe to avoid interference with a joist supporting a subfloor.

Although the present invention has been described with reference to preferred embodiments, workers skilled in the art will recognize that many changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. A barrier-free drainage apparatus for use with a shower system having a floor, the drainage apparatus comprising:

a trough positioned substantially parallel to and adjacent a front edge of the shower floor and having a bottom wall positioned below said front edge, the bottom wall having at least one outlet opening in fluid flow communication with a drain pipe, whereby water on a top surface of the shower floor flows toward the front edge thereof and into the trough, and drains out the outlet opening; and a grate having an upper, generally horizontal portion with a plurality of apertures therethrough, said grate also having means for supporting the upper portion such that said upper portion is spaced apart from the trough bottom wall in a generally horizontal position and a top surface of said upper portion is substantially the same height as the front edge of the shower floor.

2. The apparatus of claim 1, wherein the trough bottom wall slopes downward toward the outlet opening.

3. The apparatus of claim 2, wherein the trough further comprises side walls, a back wall, and a front wall having a top edge which is substantially the same height as a top surface of a finished bathroom floor.

4. The apparatus of claim 3, wherein the trough bottom wall has a plurality of spaced apart outlet openings, and said bottom wall slopes downward toward the outlet openings.

5. The apparatus of claim 4, wherein the outlet openings further comprise elongated insert receptacles depending from the bottom wall and elongated inserts adapted to fit into the insert receptacles, said insert receptacles having a side wall and a substantially horizontal base which define a cavity, each base having two spaced apart outlet openings therein adjacent opposing ends of said base, said inserts having a hole adjacent one end thereof, whereby the inserts are placed in the insert receptacles so that the insert hole is in alignment with one of the receptacle base outlet openings, thus facilitating drain pipe installation by allowing a drain pipe to avoid interference with a joist supporting a subfloor.

6. The apparatus of claim 5, wherein the elongated insert receptacles are positioned at an angle relative to the front and back walls of the trough.

7. The apparatus of claim 6, wherein the elongated inserts have a top surface which slopes upward from the end with the hole to an opposite end, whereby water entering the insert receptacle drains toward the hole.

8. The apparatus of claim 3, wherein the upper portion of the grate has a length substantially the same as the distance between the trough side walls, and a width substantially the same as the distance between the trough front back walls, said upper portion of the grate having an undulated cross-section defined by a plurality of alternating crests and valleys spanning a substantial width thereof, said crests and valleys running longitudinally along a substantial length of the upper portion of the grate parallel to the front edge of the shower floor, whereby waves of water coming from the shower floor are broken upon passing over the grate, and the water drains through the grate apertures rather than flowing past the grate.

9. The apparatus of claim 8, further comprising sidepieces extending from side walls of the trough, said sidepieces having an undulated exterior surface which is spaced apart from the bottom surface of the grate to dampen waves of water flowing under the grate adjacent the side walls.

10. A barrier-free shower pan for use with a shower system, the shower pan comprising:

a sloped platform having a back edge generally higher than a front edge such that the platform slopes generally downward from the back edge to the front edge;

a trough positioned substantially parallel to and adjacent the front edge of the platform and having a bottom wall positioned below said front edge, the bottom wall having at least one outlet opening in fluid flow communication with a drain pipe, whereby water on a top surface of the platform flows toward the front edge thereof and into the trough, and drains out the outlet opening; and a grate having an upper, generally horizontal portion with a plurality of apertures therethrough, said grate also having means for supporting the upper portion such that said upper portion is spaced apart from the trough bottom wall in a generally horizontal position and a top surface of said upper portion is substantially the same height as the front edge of the platform.

11. The apparatus of claim 10, wherein the trough bottom wall slopes downward toward the outlet opening.

12. The apparatus of claim 11, wherein the trough further comprises side walls, a back wall depending from the front edge of the platform, and a front wall having a top edge which is substantially the same height as a top surface of a finished bathroom floor.

13. The apparatus of claim 12, wherein the trough bottom wall has a plurality of spaced apart outlet openings, and said bottom wall slopes downward toward the outlet openings.

14. The apparatus of claim 13, wherein the outlet openings further comprise elongated insert receptacles depending from the bottom wall and elongated inserts adapted to fit into the insert receptacles, said insert receptacles having a side wall and a substantially horizontal base which define a cavity, each base having two spaced apart outlet openings therein adjacent opposing ends of said base, said inserts having a hole adjacent one end thereof, whereby the inserts are placed in the insert receptacles so that the insert hole is in alignment with one of the receptacle base outlet openings, thus facilitating drain pipe installation by allowing a drain pipe to avoid interference with a joist supporting a subfloor.

15. The apparatus of claim 14, wherein the elongated insert receptacles are positioned at an angle relative to the front and back walls of the trough.

16. The apparatus of claim 15, wherein the elongated inserts have a top surface which slopes upward from the end with the hole to an opposite end, whereby water entering the insert receptacle drains toward the hole.

17. The apparatus of claim 12, wherein the upper portion of the grate has a length substantially the same as the distance between the trough side walls, and a width substantially the same as the distance between the trough front wall and the front edge of the platform, said upper portion of the grate having an undulated cross-section defined by a plurality of alternating crests and valleys spanning a substantial width thereof, said crests and valleys running longitudinally along a substantial length of the upper portion of the grate parallel to the front edge of the platform, whereby waves of water coming from the sloped platform are broken upon passing over the grate, and the water drains through the grate apertures rather than flowing past the grate.

18. The apparatus of claim 17, further comprising sidepieces extending from side walls of the trough, said sidepieces having an undulated exterior surface which is spaced apart from the bottom surface of the grate to dampen waves of water flowing under the grate adjacent the side walls.

19. A barrier-free shower pan for use with a shower system, the shower pan comprising:

a sloped platform having a top surface, a back edge, a front edge, side edges, and a side wall extending upward from the side edges and the back edge, said back edge being generally higher than the front edge such that the platform slopes generally downward from the back edge to the front edge;

a trough having side walls, a back wall depending from the front edge of the platform, a bottom wall which is lower than the front edge of the platform, and a front wall having a top edge which is substantially the same height as a top surface of a finished bathroom floor, said bottom wall sloping downward toward a plurality of spaced apart outlet openings therein, whereby water entering the trough flows toward the outlet openings;

means for supporting said platform and trough on a subfloor; and a removable grate having an upper, generally horizontal portion with a plurality of apertures therethrough, and means for supporting the upper portion such that said upper portion is spaced apart from the trough bottom wall in a generally horizontal position and a top surface of said upper portion is substantially the same height as the front edge of the platform, said upper portion of the grate having a length substantially the same as the distance between the trough side walls, a width substantially the same as the distance between the trough front wall and the front edge of the platform, and an undulated cross-section defined by a plurality of alternating crests and valleys spanning a substantial width thereof, said crests and valleys running longitudinally along a substantial length of the upper portion of the grate parallel to the front edge of the platform, whereby waves of water coming from the sloped platform are broken upon passing over the grate, and the water drains through the grate apertures rather than flowing past the grate.

20. The apparatus of claim 19, wherein the outlet openings further comprise elongated insert receptacles depending from the bottom wall and elongated inserts adapted to fit into the insert receptacles, said receptacles having a side wall and a substantially horizontal base which define a cavity, and each base having two spaced apart outlet openings therein adjacent opposing ends of each base, said inserts having a hole adjacent one end thereof, whereby the inserts are placed in the insert receptacles so that the insert hole is in alignment with one of the receptacle base outlet openings, thus facilitating pipe installation by allowing a drain pipe to avoid interference with a joist supporting a subfloor.

21. The apparatus of claim 20, wherein the elongated insert receptacles and inserts are positioned at an angle relative to the front and back walls of the trough.

22. The apparatus of claim 21, wherein the elongated inserts have a top surface which slopes upward from the end with the hole to an opposite end, whereby water entering the insert receptacle drains toward the hole.

23. The apparatus of claim 19, wherein a top portion of the trough front wall bends outward, a support wall depends from the top edge thereof, and a horizontal flange extends outward from a bottom edge of the support wall, said flange having a bottom surface which rests on a subfloor.

24. The apparatus of claim 19, wherein the grate apertures are spaced apart in the center of said valleys along a substantial length thereof.

25. The apparatus of claim 24, wherein the grate means has a plurality of channels formed in the underside thereof, said channels being formed adjacent the apertures such that, for a given aperture, one channel extends horizontally at an angle toward the nearest outlet opening and the trough front wall, and another channel extends horizontally at an angle toward said outlet opening and the trough back wall, whereby water is directed toward said outlet openings.

26. The apparatus of claim 19, wherein the means for supporting the upper portion of the grate means comprises a plurality of legs extending downward from the bottom surface of said crests.

27. The apparatus of claim 26, wherein the grate has two end portions curving upward adjacent the side walls.

28. The apparatus of claim 27, wherein the grate comprises four removable sections.

29. The apparatus of claim 19, further comprising a sidepiece extending from each trough side wall, said sidepieces having an undulated exterior surface which is spaced apart from the bottom surface of the grate to dampen waves of water flowing under the grate adjacent the side walls.

30. A barrier-free shower pan for use with a shower system, the shower pan comprising:

a sloped platform having a top surface, a back edge, a front edge, side edges, and a side wall extending upward from the side edges and back edge, said back edge being generally higher than the front edge such that the platform slopes generally downward from the back edge to the front edge;

a trough having side walls, a back wall depending from the front edge of the platform, a bottom wall which is lower than the front edge of the platform, and a front wall having a top edge which is substantially the same height as a top surface of a finished bathroom floor, said bottom wall sloping downward toward a plurality of spaced apart insert receptacles therein, whereby water entering the trough flows toward said insert receptacles;

a plurality of spaced apart, elongated insert receptacles depending from the trough bottom wall and being positioned at an angle relative to the front and back walls of the trough, said receptacles having side wall means and a substantially horizontal base which define a cavity, each base having an outlet opening therein adjacent each end of said base;

a plurality of elongated inserts adapted to fit into the insert receptacles, each insert having a hole adjacent one end thereof and a top surface which slopes upward from the end with the hole to an opposite end, whereby said inserts are placed in the insert receptacles so that the insert hole is in alignment with one of the receptacle base outlet openings and water entering the insert receptacle drains toward the insert holes and out the outlet openings;

means for supporting said platform and trough on a subfloor;

a plurality of removable grates having an upper, generally horizontal portion with a plurality of apertures therethrough, and means for supporting the upper portion such that said upper portion is spaced apart from the trough bottom wall in a generally horizontal position and a top surface of said upper portion is substantially the same height as the front edge of the platform, said upper portion of the grates having a combined length substantially the same as the distance between the trough side walls, a width substantially the same as the distance between the trough front wall and the front edge of the platform, and an undulated cross-section defined by a plurality of alternating crests and valleys substantially spanning the width thereof, said crests and valleys running longitudinally along a substantial length of the upper portion of each grate parallel to the front edge of the platform, whereby waves of water coming from the sloped platform are broken upon passing over the grates, and the water drains through the grate apertures rather than flowing past the grates; and a sidepiece extending from each trough side wall, said sidepieces having an undulated exterior surface which is spaced apart from the bottom surface of the grates to dampen waves of water flowing under the grates adjacent the side walls.

31. The apparatus of claim 30, wherein a top portion of the trough front wall bends outward, a support wall depends from the top edge thereof, and a horizontal flange extends outward from a bottom edge of the support wall, said flange having a bottom surface which rests on a subfloor.

32. The apparatus of claim 31, wherein the grates have a plurality of channels formed in the underside thereof, said channels being formed adjacent the apertures such that, for a given aperture, one channel extends horizontally at an angle toward the nearest outlet opening and the trough front wall, and another channel extends horizontally at an angle toward said outlet opening and the trough back wall, whereby water is directed toward said outlet openings.

33. The apparatus of claim 32, wherein end grates have an end portion curving upward adjacent the side walls and a handle extending horizontally outward therefrom.

34. The apparatus of claim 33, wherein the radius of curvature of the crests on the curved end portion of the end grates gets progressively larger from the crest nearest the platform front edge to the crest in the center of the end grates in order to break up larger waves of water tending to flow across the curved end portions.

35. A drain apparatus for use with a water receptacle having a bottom surface, the drain apparatus comprising:

an elongated insert receptacle depending from said bottom surface, the insert receptacle having a side wall and a substantially horizontal base which define a cavity, said base having an outlet opening therein adjacent each end thereof; and an elongated insert adapted to fit into the insert receptacle, said insert having a hole adjacent one end thereof, whereby the insert is placed in the insert receptacle so that the insert hole is in alignment with one of the receptacle base outlet openings and water entering the insert receptacle drains out the outlet opening and insert hole to a drain pipe, thus facilitating drain pipe installation by allowing the drain pipe to avoid interference with an object underneath the water receptacle.

36. The apparatus of claim 35, wherein a top surface of the insert slopes upward from the end with the hole to an opposite end, whereby water drains from said opposite end toward the end with the hole.

37. The apparatus of claim 36, wherein the insert has support legs which engage the bottom wall of the insert receptacle such that a top wall of the insert is spaced apart from said bottom wall.

38. The apparatus of claim 37, further comprising a shim cap adapted to fit into one of the insert receptacle outlet openings to further seal said hole and provide a support for a support leg.

* * * * *